US008991608B2

(12) United States Patent
Zuser et al.

(10) Patent No.: US 8,991,608 B2
(45) Date of Patent: Mar. 31, 2015

(54) VIAL FOR THE REMOVAL OF PRODUCT CONTAINED IN PIECEMEAL FORM

(75) Inventors: Wilhelm Zuser, Hofstetten (AT); Robert Afflenzer, Weinburg (AT); Günter Ziegelwanger, Hofstetten (AT)

(73) Assignee: Constantia Teich GmbH (AT)

( * ) Notice: Subject to any disclaimer, the term of this patent is extended or adjusted under 35 U.S.C. 154(b) by 84 days.

(21) Appl. No.: 13/818,822

(22) PCT Filed: Aug. 9, 2011

(86) PCT No.: PCT/AT2011/000338

§ 371 (c)(1), (2), (4) Date: Jun. 7, 2013

(87) PCT Pub. No.: WO2012/024706

PCT Pub. Date: Mar. 1, 2012

(65) Prior Publication Data

US 2013/0264354 A1 Oct. 10, 2013

(30) Foreign Application Priority Data

Aug. 25, 2010 (EP) ..... 10450134

(51) Int. Cl.
*B65D 83/04* (2006.01)
*A61J 1/03* (2006.01)

(52) U.S. Cl.
CPC ..... *A61J 1/03* (2013.01); *B65D 83/0481* (2013.01)
USPC ..... 206/540; 220/268

(58) Field of Classification Search
USPC ..... 206/528, 540; 220/268, 270, 265, 266
See application file for complete search history.

(56) References Cited

U.S. PATENT DOCUMENTS 3,204,758 A * 9/1965 Horner et al. ..... 206/204
3,880,316 A * 4/1975 Martella ..... 220/268
5,894,950 A * 4/1999 Kick ..... 220/268

(Continued)

FOREIGN PATENT DOCUMENTS

DE 89 13 356 U1 1/1990
WO 2008/006123 A1 1/2008

OTHER PUBLICATIONS

Newell, Philip, "International Search Report" in connection with related PCT Application Serial No. PCT/AT2011/000338, dated Oct. 26, 2011, 3 pages.

(Continued)

*Primary Examiner* — Jacob K Ackun
(74) *Attorney, Agent, or Firm* — Kolisch Hartwell, P.C.

(57) ABSTRACT

A lid for a pharmaceutical bottle that is configured to facilitate the withdrawal of goods present in the pharmaceutical bottle in the form of pieces, the lid including at least an inner layer and an outer layer. The inner layer, which may be a multilayer structure, is firmly sealed with and along the peripheral, circular edge of the pharmaceutical bottle and has a peripheral weakened line off-set from the center of the circle, where the peripheral weakened line of the opening has a concave section in the portion thereof that is next to the sealing edge. The outer layer, which may be a multilayer structure, is connected to the inner layer and can be peeled off such that the portion of the inner layer lying inside the peripheral weakened line remains on the outer layer, thereby forming an opening in the inner layer.

10 Claims, 3 Drawing Sheets

(56) References Cited

U.S. PATENT DOCUMENTS

| | | | | |
|---|---|---|---|---|
| 7,395,928 | B2 * | 7/2008 | Bertsch et al. | 206/531 |
| 2007/0267304 | A1 | 11/2007 | Portier | |
| 2009/0311475 | A1 * | 12/2009 | Kornfeld et al. | 428/138 |
| 2013/0064934 | A1 * | 3/2013 | Vogt et al. | 426/106 |

OTHER PUBLICATIONS

Newell, Philip, "Written Opinion" in connection with related PCT Application Serial No. PCT/AT2011/000338, dated Oct. 26, 2011, 5 pages.

* cited by examiner

VIAL FOR THE REMOVAL OF PRODUCT CONTAINED IN PIECEMEAL FORM

The invention relates to a vial for pills, coated tablets, powders, tablets and other product contained in piecemeal form, such as drugs, food supplements, flavoring agents, sweeteners, colorants and preservatives, as well as foods, such as cereal or nuts, which are present in bulk in the vial, and specifically to a closure for such a vial, in accordance with the preamble to claim 1.

With regard to the prior art, reference is made to DE 89 13 356 U. This document discloses a tablet bottle, the opening of which is provided with at least two "humps", which project inward in a plane perpendicular to the bottle axis and form between them a "trough". This has the effect of making the removal of individual tablets easier. Drawbacks are the complex manufacture of the bottle and the difficult filling of the same as a result of the small removal opening.

From US 2007/0267304 it is known to use a closure for a tablet bottle, which closure possesses a small central opening, in addition has a considerable height in the direction of the bottle axis and, starting from its opening, widens out toward the interior of the bottle. The closure thus forms a funnel, which is intended to enable the removal of individual tablets. Drawbacks are the demands made by the complexly configured closure, the large spatial requirement for the closure in the region of the neck of the bottle, and the problems of blockage of the funnel region and the resealing, which in most embodiments is difficult, inside the neck of the bottle.

Said drugs, food supplements, vitamin preparations, etc., are often not individually packed in so-called blister packs, but are sold in bulk in so-called vials made of glass or, in recent years, increasingly to almost exclusively of plastic.

Usually these vials are closed by a screw closure with screw cap, wherein, as an identification of guarantee of intactness at the time of purchase, either a guarantee ring is provided on the cap, which guarantee ring breaks when the cap is unscrewed for the first time, or else inside the cap a guarantee lid, generally made of aluminum or a plastic composite, is sealed on over the rim of the neck of the vial. This lid must be peeled off by the user when he wishes to access the content of the vial and thus fulfils the guarantee function.

The use of such vials for pharmaceuticals, food supplements, etc. is actually an anachronism if one bears in mind that the manufacture and filling of the packaging takes place in an environment which places almost the same demands on sterility and cleanliness as an operating theatre, and if one then bears in mind that the user, in his attempt to shake out a tablet (hereinafter, for reasons of simplicity, only tablet(s) are ever mentioned and the other specific designations of individual dosage forms are implicitly jointly understood thereby), virtually always shakes a plurality of tablets from the vial (generally onto a hygienically thoroughly dubious surface) and, with his bare fingers, throws those which he does not need back into the vial, where they in many cases remain unused for months, in which time the attached sweat and skin scales, etc. start to decompose.

Since on the market, however, vials of this type continue to be in heavy demand from end users and are in many cases preferred to the blister packs which are likewise on offer, the requirement exists for an improved option for the dispensing of the tablets from the vials.

The object of the invention is thus to provide a closure for such a vial which facilitates the removal of individual tablets and at least substantially prevents a multiplicity of tablets from being emptied out with a shaking movement. At the same time, this closure should be cheap to produce, require little space, and make handling intuitively possible for the user.

According to the invention, these objects are achieved by the features stated in the characterizing part of claim 1.

In other words, the closure not only consists of a screw cap or snap-on cap, but also of an at least two-layered lid, which fulfils the guarantee function and, when it is pulled off, an inner layer, a possibly multi-ply plastics film, remains on the rim of the opening, this plastics film having a dispensing opening which is provided eccentrically on the circular film surface and, on the side facing the circular rim, has at least one concave portion.

In this way, that part of the plastics film which projects inward from the imaginary chord of the two ends of the concave portion acts as a type of brake for the tablets to be emptied out and thus facilitates the removal of individual tablets from the vial.

Lids, as can be used according to the invention, are variously known per se in the prior art, in which context reference shall be made only to WO 2008/006123 A of the Applicant, in particular also to FIG. 5 of this document. The material which is disclosed there substantially consists of two mutually connected layers, which can respectively be of multi-ply configuration. The inner layer is sealed onto the respective container rim and has at a distance from the container rim a self-contained weakening line. The outer layer can be detached, generally by means of a tab. Since the connecting force between the two layers is less than the force which connects the inner layer in the seal region to the container rim, the two layers separate and that region of the inner layer which is demarcated from the remainder by the self-contained weakening line remains stuck on the detached outer layer, so that an opening in the inner layer is exposed, which opening is substantially smaller than the part which, by virtue of the remaining sealing to the container rim, covers the opening.

This technology is essentially used, in receptacles, after the outer layer has been detached, as far as possible to prevent liquid from being poured out and nevertheless provide a drink opening, or to provide an opening for a drinking straw or the like. This document was also published as US 2009/0311475 A1, the content of which document is made by reference, for the nations in which this is possible, the content of the present application.

A similar material of similar configuration, which is used for the same purpose, is known from EP 812 782 A; the content of this document as well is made by reference, for the nations for which this is possible, the content of the present application.

A further similar material of similar configuration, which is used for the same purpose, is known from US 2004/0013827 A1 of the Applicant; the content of this document as well is made by reference, for the nations for which this is possible, the content of the present application.

Another similar material of similar configuration, which is used for the same purpose, is known from WO 2006/113951 A1 of the Applicant; the content of this document as well is made by reference, for the nations for which this is possible, the content of the present application.

A further similar material of similar configuration, which is used for the same purpose, is known from GB 2 027 664 A; the content of this document as well is made by reference, for the nations for which this is possible, the content of the present application.

Another similar material of similar configuration, which is used for the same purpose, is known from U.S. Pat. No. 4,735,335; the content of this document as well is made by reference, for the nations for which this is possible, the content of the present application.

Over the course of time, this technology has been variously refined and configured and adapted to different fields of application, yet the created opening has in no case hitherto been used for a purpose other than access to the interior of the container. This begins in the manufacture of particularly small openings, through which the excess pressure in packagings whose content is heated in the microwave oven can escape or be relieved. Access openings for drinking straws or drink openings have already been mentioned, and further openings are known for the pouring out of liquids while, at the same time, the product to be cooked, for example rice, is intended to be reliably retained.

The invention is represented in greater detail below with reference to the drawing, which shows in purely schematic representation some embodiments of the invention, wherein:

FIG. 1 shows the vial 1 with inventive closure in the closed state.

FIG. 2 shows the vial 1 of FIG. 2 with removed screw cap and intact guarantee closure.

Figure 3:
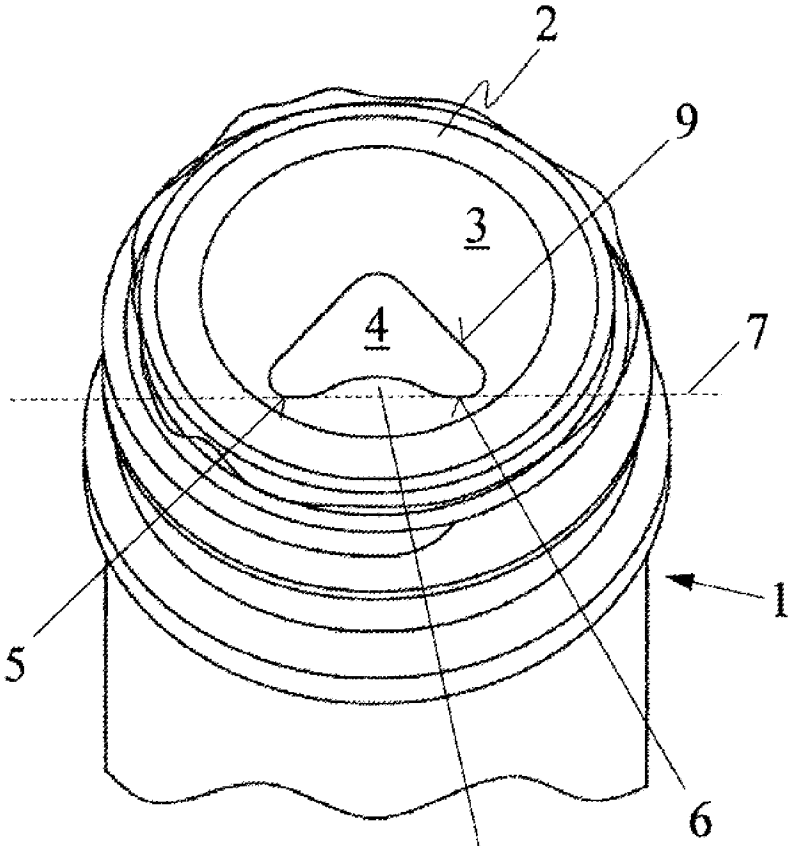
FIG. 3 shows a view of a vial as in FIG. 1 or 2, with detached guarantee closure and exposed removal opening.

FIG. 3 shows the vial 1 with detached guarantee closure and exposed opening 4, as it, after the guarantee closure has been peeled off, remains stuck on the rim of the vial 1 along a circumferential sealing rim 2 and covers the bottle opening in the region 3 and exposes only an opening 4. The opening 4, which is bounded by a weakening line 9, is arranged eccentrically to the circular sealing rim 2 or to its center point and has on the side lying nearest to the sealing rim 2 a concave portion. This is constituted by that region of the periphery of the opening 4 which lies between the points 5 and 6, which are points of contact with a tangent 7. The region 8 lying between the periphery of the opening 4 and the tangent 7 serves as a type of tab or tongue, which makes it specifically so much more difficult to shake tablets out of the vial that the number of tablets which are dispensed with a normal shake-out movement is heavily reduced and is preferably reduced to one tablet.

Figure 2:
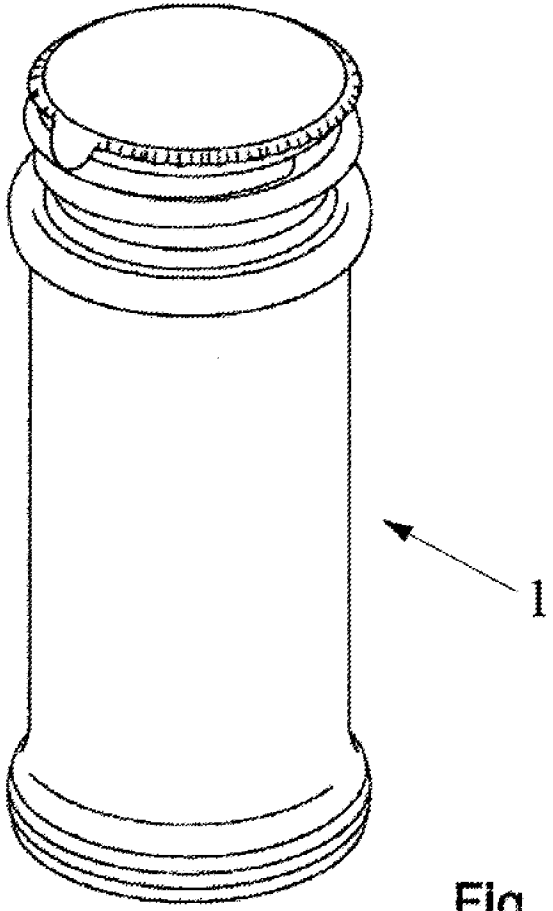
FIG. 2 shows the vial of FIG. 1 with removed screw cap and intact guarantee closure.
Figure 1:
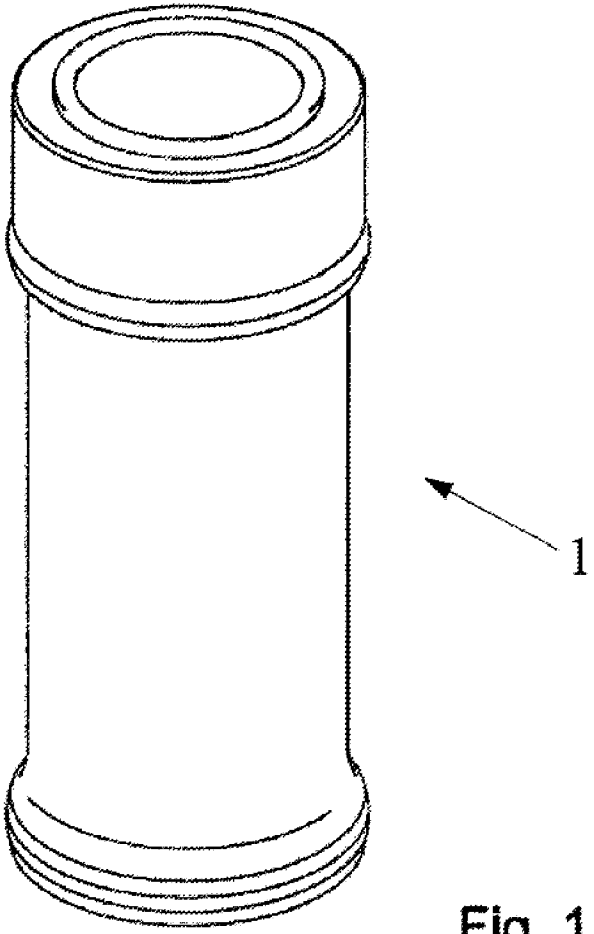
FIG. 1 shows a vial having an inventive closure in the closed state.
Figure 4:
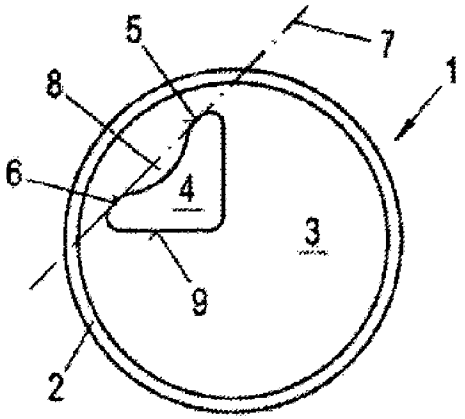
FIGS. 4 to 8 show various forms of inventive removal openings, purely schematically in top view.

FIG. 4 shows the variant of the inventive opening 4, in wholly schematic representation, namely a top view of an inner plastics film, as configured in FIG. 3.

Figure 5:
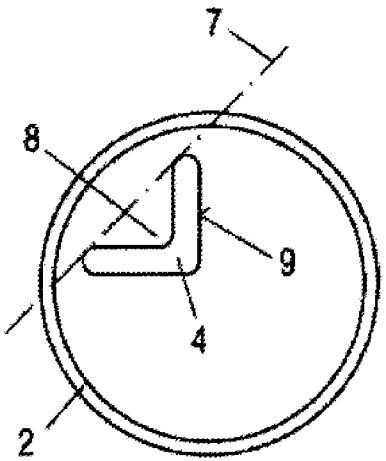

FIG. 5 shows a variant in which the tab 8 is significantly larger than that shown in FIG. 4, wherein, as tablets are shaken out, this tab 8 bends, for instance in the region of the tangent 7, and thus controls the dosing.

Figure 6:
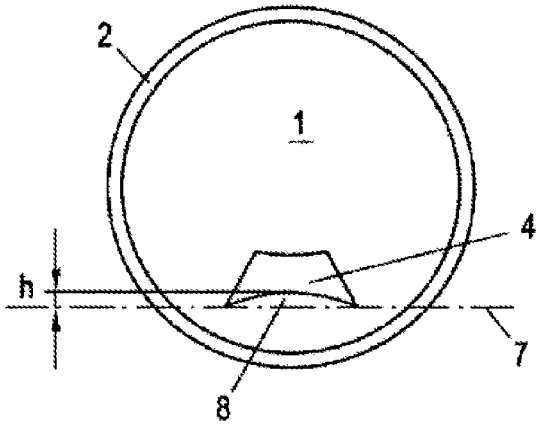
Figure 7:
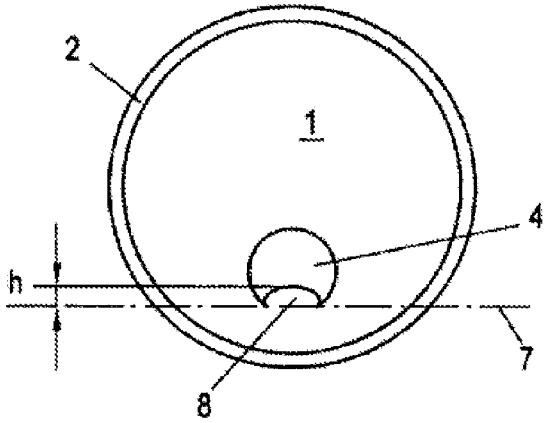
Figure 8:
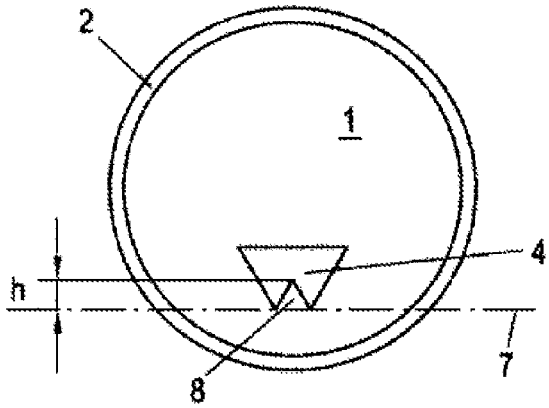

Other variants are represented in FIGS. 6 to 8, FIG. 6 showing a variant having an opening 4 which is bounded by two roughly radially extending rims at the sides and two concave rims extending roughly in the peripheral direction, both on the side assigned to the periphery 2 and on the side assigned to the center. In the case of this opening, two tabs are thus formed, through which tabs tablets pass as through lips, and are thus isolated, when a shaking movement is made in connection with dispensing.

FIG. 7 shows a variant in which an opening 4, bounded, for instance, by a circle or an oval, has on the side of the periphery a tab 8, which has an approximately elliptical shape and is here configured, as a peculiarity, beyond its principal axis, so that the remaining opening 4 is approximately sickle-shaped.

FIG. 8 shows an opening 4, which is bounded in a straight line all the way round, and the tab 8 has the shape of a triangle, which extends with its base along a chord of the circular sealing seam or sealing rim 2 and the apex of which is directed to the center of the lid. Like the other tabs too, this then also bends as intended as a tablet is shaken out, and thus has a braking and isolating effect.

The invention is not limited to the represented embodiments, but can be variously changed and adapted to the respective application.

Having regard to the size, the mass, the surface properties and other characteristics of the tablets which are to be removed from the vial, it is possible for the person skilled in the art within the field of the packaging industry to determine the optimal shape and size of the opening 4 on the basis of just a few trials.

Since lids of this type are already variously known in the prior art for the purposes stated in the introduction and the person skilled in the art, having regard to the invention, can transfer these easily to the inventive application, it is not necessary to discuss their structure, and the materials used herein, in further detail.

It is of importance that the opening 4 is arranged eccentrically, since any user, when tilting and shaking the vial, instinctively places the opening at the bottom, whereby in the inventive arrangement the tab 8, which then projects upward from the rim, can best fulfill its function.

What is claimed is:

1. A system for dispensing a bulk product in piecemeal fashion, comprising:

a vial having a circumferential circular rim; and a lid having an inner layer and an outer layer;

the inner layer being tightly sealed along the rim of the vial and incorporating a circumferential weakening line disposed eccentrically with respect to a center of the circular rim; and the outer layer being removably attached to the inner layer, so that when the outer layer is removed from the inner layer, the portion of the inner layer disposed within the circumferential weakening line is removed with the outer layer, forming thereby a dispensing opening in the inner layer;

wherein the weakening line is configured so that the portion of the dispensing opening nearest the sealing rim includes at least one concave portion.

2. The system of claim 1, wherein the concave portion of the dispensing opening defines a convex region of the lid adjacent the sealing rim.

3. The system of claim 2, wherein the convex region defined by the dispensing opening forms a tab.

4. The system of claim 3, wherein the tab is configured to flex as the bulk product is dispensed.

5. The system of claim 3, wherein the tab is bounded by at least two points along the weakening line and corresponds to the convex region of the lid that extends beyond a tangent defined by the at least two points.

6. The system of claim 5, wherein the tab is substantially triangular.

7. The system of claim 1, wherein the dispensing opening is approximately sickle-shaped.

8. The system of claim 1, further comprising a bulk product sealed in the vial, where the bulk product is a medicament, a food supplement, or a sweetener.

9. The system of claim 1, wherein the bulk product is configured to be dispensed piecemeal as a tablet, a pill, or a powder.

10. The system of claim 1, wherein one or more of the inner layer and the outer layer has a multi-ply configuration.

* * * * *